US007161558B1

(12) United States Patent
Eidem et al.

(10) Patent No.: US 7,161,558 B1
(45) Date of Patent: Jan. 9, 2007

(54) CALIBRATION SYSTEM FOR AN ELECTRONIC SIGN

(75) Inventors: Ryan Paul Eidem, Brookings, SD (US); Brent Allan Joffer, Brookings, SD (US); Reece Allen Kurtenbach, Brookings, SD (US); Thomas Raymond Mittan, Brookings, SD (US); Robert Edward Seeley, Aurora, SD (US)

(73) Assignee: Daktronics, Inc., Brookings, SD (US)

( * ) Notice: Subject to any disclaimer, the term of this patent is extended or adjusted under 35 U.S.C. 154(b) by 940 days.

(21) Appl. No.: 09/841,365

(22) Filed: Apr. 24, 2001

(51) Int. Cl.
*G09G 5/00* (2006.01)

(52) U.S. Cl. ..... 345/3.1; 345/3.2; 345/3.3; 345/3.4; 345/589; 345/590; 345/748; 345/749

(58) Field of Classification Search ..... 345/589, 345/590, 748, 749, 698, 3.1, 3.2, 3.3, 3.4
See application file for complete search history.

(56) References Cited

U.S. PATENT DOCUMENTS 5,363,318 A * 11/1994 McCauley ..... 702/85
5,600,574 A * 2/1997 Reitan ..... 702/185
5,642,125 A * 6/1997 Silverstein et al. ..... 345/87
6,219,099 B1 * 4/2001 Johnson et al. ..... 348/383
6,826,307 B1 * 11/2004 Lau et al. ..... 382/199

* cited by examiner

*Primary Examiner*—Kee M. Tung
*Assistant Examiner*—Tam Tran
(74) *Attorney, Agent, or Firm*—Hugh D. Jaeger, Esq.

(57) ABSTRACT

Electronically programmed signs consist of any array of picture elements (pixels) that can be controlled independently to create an image. Varying the intensity of each pixel and adding multiple colors per pixel will enhance the image quality. It is currently common to have displays that use one, two or three separate colors in a pixel (monochrome, red-green, and red, green and blue) with intensity levels of two, four, eight up to 256 and beyond. Multiple colored pixels can combine colors at various intensity levels to expand the displayable color palette. The number of colors it is possible to display is calculated by the following formula:

$$\text{total number of displayable colors} = \frac{(\text{number of primary colors})}{(\text{number of intensity levels per colors})}$$

While raising the number of intensity levels and colors improves image quality, it also raises the viewer's sensitivity to inconsistencies in both parameters.

32 Claims, 3 Drawing Sheets

CALIBRATION SYSTEM FOR AN ELECTRONIC SIGN

CROSS REFERENCES TO CO-PENDING APPLICATIONS

None.

BACKGROUND OF THE INVENTION

1. Field of the Invention

The present invention is in the field of electronically controlled display calibration systems. If the display has the ability to provide intensity offsets for individual pixels, the system can measure and adjust multiple pixels simultaneously in a closed loop system.

2. Description of the Prior Art

Early display systems relied on calibration of individual pixels at the manufacturing level. However, individually calibrating thousands of pixels is time consuming and it is easy for problems to creep into the process. Also, all of the display technologies used to date slowly lose intensity over time in a process called degradation. This caused pixels that were added into the sign due to normal maintenance to appear brighter than the others.

These issues required display manufacturer's to design in the ability to adjust pixel intensity in the field once the display was installed (field calibration). When field calibration was done, it required a person to manually tune sections of a display brighter or dimmer based on their perceptions. This process was repeated for all colors across the display until either the display was determined to be uniform or fatigue forces the procedure to stop. It is very rare for this method to successfully create a display free of visual discontinuities. These inconsistencies are especially noticeable on full color displays that mix red, green and blue elements since the differences are additive.

SUMMARY OF THE INVENTION

The general purpose of the present invention is to provide an improved calibration system for an electronically controlled sign including an imaging system for supplying image data of the electronic sign, a personal computer or similar device which accepts image data from the imaging system and converts it to digital data and commands in a format which corresponds exactly to the pixels available in the sign.

The invention is to be used to remove visual discontinuities from electronic displays. Typically, the luminance of individual display elements is different unless some form adjustment is applied to control the luminance output. This invention determines the amount of adjustment needed to each display element by use of an imaging system connected to a personal computer.

An imaging system can be used to capture a detailed image of an electronic display. These images need to contain enough detail and resolution that each pixel can be identified and their individual luminance values determined for each color. Once the individual luminance of each pixel is determined, this value can be inputted into an algorithm, which will determine the correct amount of adjustment necessary to increase or decrease the luminance of the pixel. By using a properly programmed personal computer, the determination of luminance values and the resulting adjustment values can be automated.

According to one embodiment of the present invention, there is provided a calibration system, including a digital camera, a computer system, a memory card to transfer the digital image from the camera to the computer system, a computer program that analyzes the digital image and automatically adjusts the luminance of the pixel, and a connection to the electronic display to transfer the resulting adjustment file to the display.

An operator takes a picture of the display using the digital camera from an angle approximately normal to the display face and a distance at which the entire display or display section will fill the lens. This may require additional lenses depending on the area in which the display was installed. The digital image is then transferred to computer system using a memory card or other such device used in digital camera technology. A monochrome camera can be used for a single color display, but a multiple color display will require a color camera or a monochrome camera with appropriate filtering to remove unwanted color wavelengths from the image.

The operator then needs to make reference points throughout the image. This is critical because a digital camera uses a charge coupled device (CCD) to capture the image passing through the lens. The CCD is essentially an array of pixels (camera pixels) that will reference the pixels on the electronically programmable display (display pixels). The reference points allow the computer to align the camera pixels to the display pixels, allowing the software to accurately compare sections of the display and to correct for image distortions. Two examples of causes for image distortions are the angle the image was taken from (i.e., not directly in front of the display), and lens distortion (this last concept is very similar to how satellite imagery is "tied" to maps and GIS databases).

The operator specifies the pixel array of the display. For example, if a display is 208 pixels high by 272 pixels wide (23'30' with 34 mm distance between pixels), the software will divide the image into 56,576 sections (208 *272=56,576), each section representing one pixel. This requires a very high resolution camera since it is best to have multiple camera pixels representing one display pixel. The software program then measures brightness of each section of the digital image and compares all of the brightness levels across the display and calculates a preferred brightness level that is an approximate average brightness.

Once the average brightness is determined, the software then calculates an adjustment to each pixel and sends the adjustment value to the display to compensate for inconsistencies. This compensation is performed by varying the power applied to an individual pixel/pixel color. Examples of this would be varying the duty cycle that an element is on, or changing the current delivered to an element.

The use of an imaging system with a software program to align the imaging pixels with the display pixels is a significant improvement over previous methods because it is much faster and iterative. Therefore, the process can be repeated if desired until the consistency is satisfactory. The first few times will cause the most dramatic changes with further iterations continuing to refine the uniformity.

Having thus described embodiments and significant aspects and features of the present invention, it is the principal object of the present invention to provide a system to remove discontinuities from the pixels of an electronically programmable display using an iterative, closed loop system to that removes human error and can be repeated over the life of the display.

One object of the present invention is to achieve a much improved uniformity of the electronic display Visual discontinuities are virtually undetectable. In a side-by-side comparison, the results of this method have been deemed far superior in every test case.

Another object of the present invention is the invention requires much less input from the operator (i.e., the opportunity for human error is removed from the determination of brighter and dimmer).

Yet another object of the present invention is the invention decreases the opportunity for eyestrain. The operator must only view the display for a short time during the imaging process. The previous method required the operator to view the display for hours at a time.

A further object of the present invention is the invention requires many fewer man hours. With the ability to image an entire display and then use the automation of a personal computer to determine adjustment values, an electronic display can be adjusted to uniformity within a few hours.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
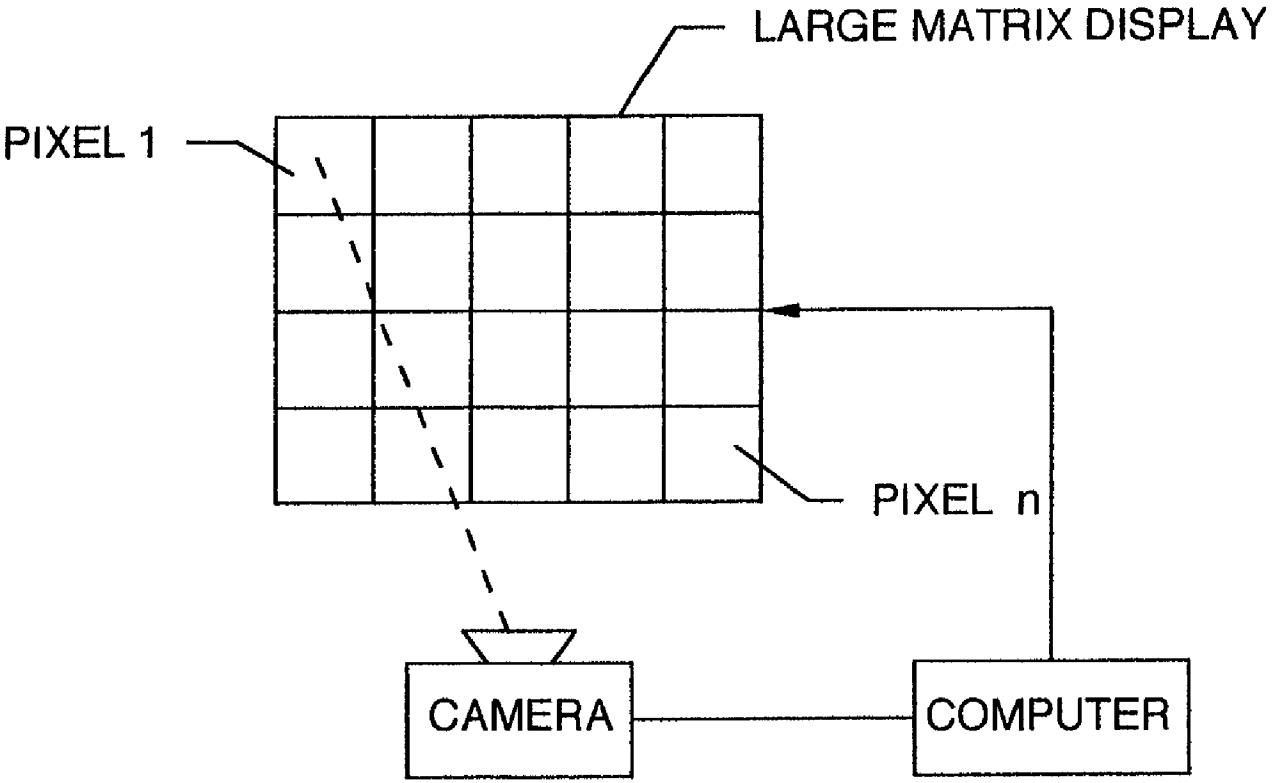
FIG. 1 illustrates a pictorial view of the system.
Figure 2A:
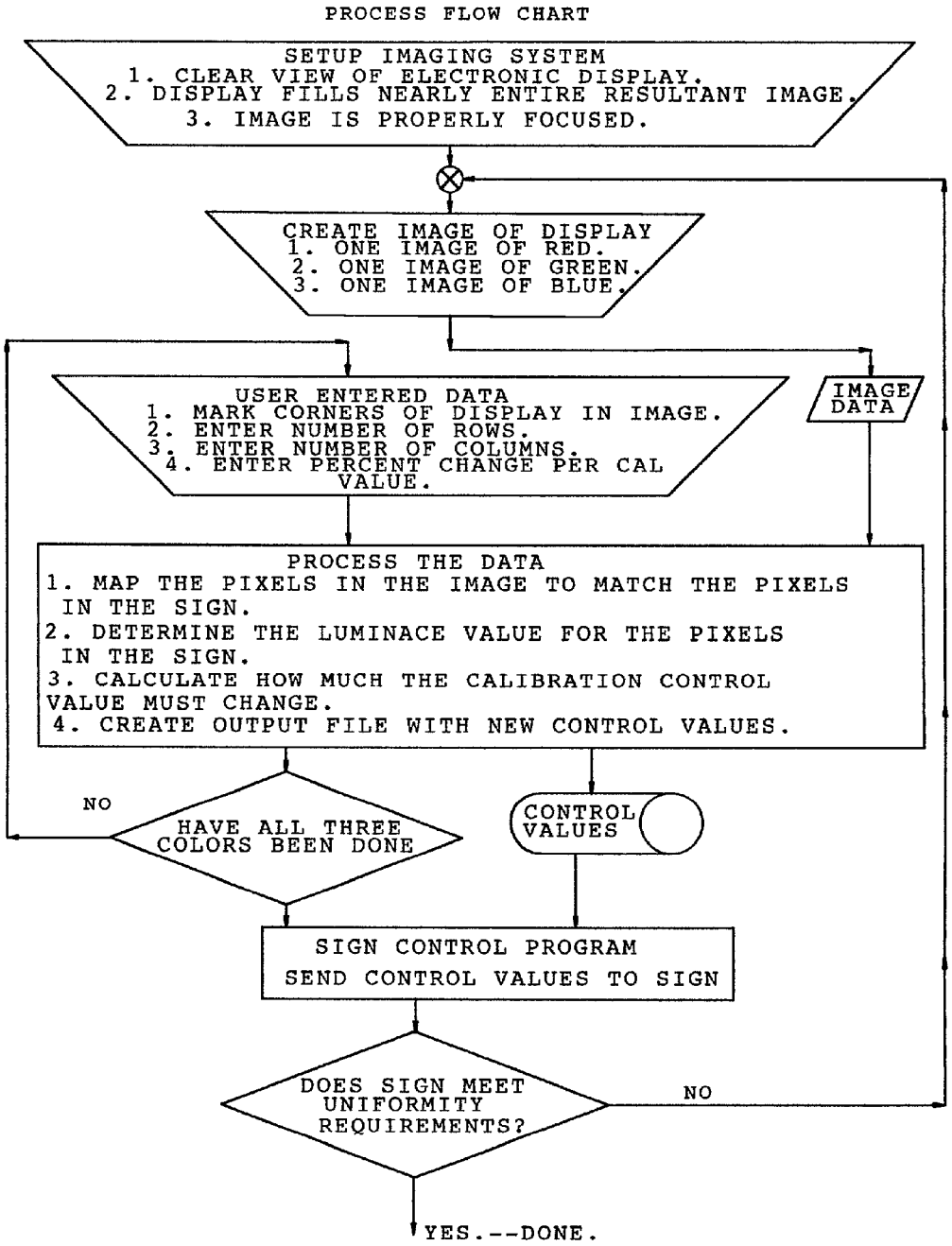
FIGS. 2A and 2B illustrate a flow chart for the software program.
Figure 2B:
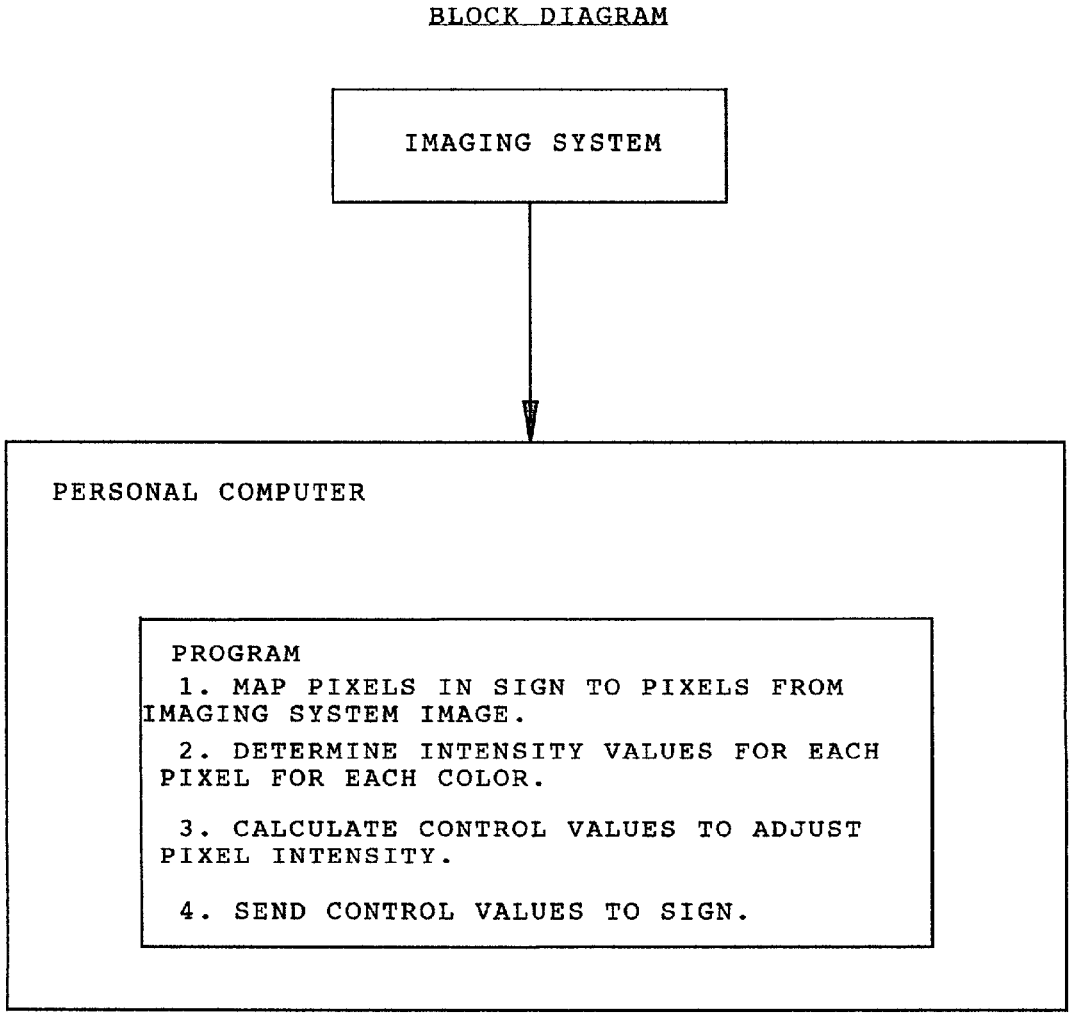

The imaging system must either produce a color image or use the proper filters to produce a monochrome image. In addition, the imaging system must be of high enough resolution that each pixel in the sign or section of sign is represented by multiple pixels in the imaging system. Finally, the imaging system must have lenses which allow the sign section of interest to nearly fill the available image area of the imaging system. The imaging system is then used to obtain three digital images of the sign. These images are of the entire sign displaying each of the three colors, red, green and blue. These images are then transported to the personal computer.

The personal computer contains software which interprets the image data from the imaging system and through the use of user supplied parameters uses a formula to convert the image data into control data which corresponds exactly to each display element in the display. This control data will be sent to the electronic sign and will control the relative brightness of each color on each display element. The final result will be a sign with no visual discontinuities when viewing solid colors.

The first step in interpreting the digital image from the imaging system is to map the pixels from the imaging system's image to the pixels on the sign. Typically, the imaging system uses a charge coupled device (CCD) to capture the image. This CCD device is made up of many rows and columns of sensors (for example, 1024×1024). This allows the imaging system to produce an image which is of a corresponding size and structure. The number of pixels and arrangement of pixels in the imaging system will not match exactly the number of pixels and arrangement of pixels in the sign. For example, some standard imaging systems have CCD arrays, which produce images of 1024×1024, and the signs these might be used on are 208×272. As can be quickly seen, one pixel in the sign does not map directly to one pixel in the imaging system's image. The simplest solution would be to mark the corners of the digital image and divide the remaining pixels by the number of rows and columns in the sign. Then, particular groups of pixels in the digital image would be mapped to represent one pixel in the sign. Each group of image pixels would have their average value determined and this value would be assigned to the corresponding pixel in the sign.

At this point, one algorithm can be used to determine the control values to send to the sign. The algorithm used for each color on each pixel follows:

$$nChange = \frac{(fExpectedValue \sim fPixelValue)}{(fExpectedValue)} * \frac{1.0}{fPercentChangePerCalValue}$$

nChange—the amount the calibration control value should change for this color on this pixel. This is the output of the formula.

ƒExpectedValue—the value this color on all pixels is to be adjusted to. This value is either user supplied or the average value of the image data from the camera.

ƒPixelValue—the current pixel value for this color. This value is calculated from the camera image data from as stated above.

ƒPercentChangePerCalValue—the factor which converts a percentage change needed to a calibration control value. This value is sign dependent and is entered as a user supplied parameter.

Therefore, each pixel will have three control values determined by using the above formula for each color. Once these control values are determined, they are downloaded to the sign. During this process, statistics (i.e., mean, variance, minimum, maximum) are determined. If it is felt that these statistics are not in the proper ranges or the display does not have the desired visual appearance, the process is repeated. Usually, no more than four or five iterations are necessary.

MODE OF OPERATION

The imaging system is placed in a location with a clear view of the electronic sign. The lenses on the imaging system are adjusted so that the imaging system can capture as large an image of the entire sign as possible and also to ensure the image is in the proper focus. Next, an image (of the sign) is captured for each of the three colors, red, green and blue, being displayed on the sign. Next, each of three images is run through the following process.

The image is loaded into a program (reference is made to the flow chart). Within this program, the corners of the sign are marked in the image, the number of rows and columns of the sign are entered, and the ƒPercentChangePerCalValue is modified, if necessary. Then, the program performs the necessary calculations and creates a file. This file contains the control values which indicate the adjustments necessary for each color on each pixel to bring the electronic display into visual uniformity. The program also outputs statistics to indicate the level of variation found within the data. The control information is downloaded to the sign through the use of sign control software.

This process is repeated until the statistics indicate the desired level of uniformity has been reached and the operator is satisfied with the appearance of the display (usually, within four or five iterations).

The imaging device can be of several different formats. Typically, a high resolution color digital camera is used with a removable media to store the images. However, in some cases either a digital camera or a video camera may be used and connected directly to the personal computer.

In some cases, it is beneficial to mark more than just the corners of the image. To correct for lens distortions or the angle an image is taken from, a grid of points may be marked within the image. Usually a small number of points (16 or 20) is enough to ensure accurate results when determining the control adjustments.

Various modifications can be made to the present invention without departing from the apparent scope hereof.

The invention claimed is:

1. A process for calibrating an electronic sign, the electronic sign having a plurality of individual display pixels, each individual display pixel of the plurality of individual display pixels having a separately controllable intensity offset, the process comprising the steps of:

a. using an imaging device to take an image of the electronic sign;

b. using that image to determine the control values needed to bring the individual display pixels of the plurality of individual display pixels of the electronic sign into uniformity by separately controlling the intensity offset of each individual display pixel.

2. The process of claim 1, wherein the electronic sign is a monochrome display.

3. The process of claim 1, wherein the electronic sign is a multiple color display.

4. The process of claim 3, wherein the electronic sign has red, green and blue color capability.

5. The process of claim 3, wherein the electronic sign is a multiple color display and the imaging device distinguishes the multiple colors of the multiple color display of the electronic sign.

6. The process of claim 5, wherein the imaging device includes color filters to distinguish the multiple colors.

7. The process of claim 1, wherein the imaging device is a digital camera.

8. The process of claim 1, wherein the imaging device is a video camera.

9. The process of claim 8, wherein the video camera is a monochrome video camera.

10. The process of claim 8, wherein the video camera is a multiple color video camera.

11. The process of claim 1, wherein the imaging device includes a charge coupled device (CCD).

12. The process of claim 11, wherein the charge coupled device (CCD) includes a plurality of sensors, and wherein the sensors of CCDs are arranged in rows and columns.

13. The process of claim 12, wherein the electronic sign includes a plurality of pixels and wherein sensors in the plurality of sensors in the imaging device exceeds pixels in the plurality of pixels in the electronic sign.

14. The process of claim 13, wherein each of the pixels of the plurality of pixels of the electronic sign are mapped to at least one sensor of the plurality of sensors of the imaging device.

15. The process of claim 14, wherein each of the pixels of the plurality of pixels of the electronic sign are mapped to multiple sensors of the plurality of sensors of the imaging device.

16. The process of claim 15, wherein the electronic sign includes four corners, which four corners mark the image for mapping the each of the pixels of the plurality of pixels of the electronic sign so as to assign corresponding multiple sensors of the imaging device.

17. The process of claim 16, further comprising the step of dividing the pixels between the four corners into rows and columns corresponding to pixel rows and columns of the electronic sign.

18. The process of claim 16, further comprising the step of dividing the plurality of corresponding multiple sensors assigned to each pixel of the electronic sign between the four corners into rows and columns corresponding to pixel rows and columns of the electronic sign.

19. The process of claim 16, further comprising the step of providing a grid of a small number of points on the electronic sign to correct the mapping for distortions.

20. The process of claim 19, wherein the distortions are caused by the lense of the imaging device.

21. The process of claim 19, wherein the distortions are caused by the angle of the imaging device to the electronic sign.

22. The process of claim 19, wherein the small number of points in the grid is from 16 to 20.

23. The process of claim 15, wherein the multiple sensors of the imaging device corresponding to a pixel of the sign are defined as an image pixel further comprising the step of averaging the value of the multiple sensors of an image pixel.

24. The process of claim 23, wherein the electronic sign is a red, green, blue electronic sign and the multiple sensors corresponding to each pixel of the sign, defining each image pixel, are averaged for red, green and blue, so as to determine a red, a green, and a blue value for each sign pixel.

25. The process of claim 24, wherein a difference between the determined value and a desired value is calculated for each sign pixel for red, green, and blue.

26. The process of claim 25, wherein the calculated differences are used to readjust and control each sign pixel for red, green, and blue.

27. The process of claim 26, wherein a statistical characterization of electronic sign is determined.

28. The process of claim 27, wherein the statistical characterization of the electronic sign includes a mean, a variance, a minimum, and a maximum for the calculated differences for each sign pixel for red, green, and blue.

29. The process of claim 28, wherein iterative repetition is continued until a desired statistical characterization is reached, which desired statistical characterization is indicative of acceptable uniformity.

30. The process of claim 1, wherein the imaging device includes a lense.

31. The process of claim 1, wherein the device is a camera having a removable storage medium, which removable storage medium, including the image of the electronic sign, is transferred to a personal computer for processing.

32. The process of claim 1, wherein the device is connected directly to a personal computer, such that the image is transferred to the personal computer for determining the control values.

* * * * *